US007081852B2

(12) United States Patent
Kuroda et al.

(10) Patent No.: US 7,081,852 B2
(45) Date of Patent: Jul. 25, 2006

(54) WIDE BAND ANTENNA

(75) Inventors: Shinichi Kuroda, Tokyo (JP); Tomoya Yamaura, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 11/107,878

(22) Filed: Apr. 18, 2005

(65) Prior Publication Data

US 2005/0184913 A1 Aug. 25, 2005

Related U.S. Application Data

(63) Continuation of application No. 10/395,078, filed on Mar. 25, 2003, now Pat. No. 6,914,561.

(30) Foreign Application Priority Data

Apr. 9, 2002 (JP) ..... 2002-106417

(51) Int. Cl.
*H01Q 1/38* (2006.01)
*H01Q 1/24* (2006.01)

(52) U.S. Cl. ..... 343/700 MS; 343/702

(58) Field of Classification Search ..... 343/702, 343/700 MS, 846, 848, 844
See application file for complete search history.

(56) References Cited

U.S. PATENT DOCUMENTS

| | | | | |
|---|---|---|---|---|
| 4,600,018 | A | 7/1986 | James et al. | 128/804 |
| 6,133,883 | A | 10/2000 | Munson et al. | 343/700 MS |
| 6,285,325 | B1 * | 9/2001 | Nalbandian et al. | 343/700 MS |
| 6,384,785 | B1 * | 5/2002 | Kamogawa et al. | 343/700 MS |
| 6,437,756 | B1 | 8/2002 | Schantz | 343/866 |
| 6,697,025 | B1 * | 2/2004 | Koyanagi et al. | 343/741 |
| 6,720,926 | B1 | 4/2004 | Killen et al. | 343/700 MS |
| 2003/0038751 | A1 | 2/2003 | Iwai et al. | 343/700 MS |
| 2003/0214444 | A1 * | 11/2003 | Asai et al. | 373/700 MS |

* cited by examiner

*Primary Examiner*—Don Wong
*Assistant Examiner*—Minh Dieu A
(74) *Attorney, Agent, or Firm*—Oblon, Spivak, McClelland, Maier & Neustadt, P.C.

(57) ABSTRACT

Disclosed is a wideband antenna with a lowered standing wave ratio. The wideband antenna interposes a substance whose conductivity is about 0.1 through 10.0 as an interposition between a reference conductor and a radiation conductor; and thereby, the antenna reduces reflections of signals, and achieves a wider bandwidth as well as a sufficient gain with a lowered standing wave ratio. Also, the invention realizes a thin-type wideband antenna with a wider bandwidth and a sufficient gain, by interposing a magnetic substance whose relative permeability is more than 1 through about 8 as the interposition between the reference conductor and the radiation conductor.

6 Claims, 18 Drawing Sheets

FIG.2

| | CHARACTERISTIC OF DIELECTRIC | | | | DIMENSION OF ANTENNA | | MATCHING CAPACITANCE [pF] |
|---|---|---|---|---|---|---|---|
| | εr | μr | σ [/Ωm] | tan σ [at 4GHz] | le [mm] | gf [mm] | |
| FIG.3 DIELECTRIC | 4.0 | 1.0 | 0.1 | 0.11 | 15.0 | 7.5 | nil |
| FIG.4 DIELECTRIC | 4.0 | 1.0 | 1.0 | 1.1 | 15.0 | 7.5 | Cp:1.5 |
| FIG.5 DIELECTRIC | 4.0 | 1.0 | 10.0 | 11.0 | 15.0 | 7.5 | Cp:1.5 |

FIG.11

| | CHARACTERISTIC OF MAGNETIC SUBSTANCE | | | | DIMENSION OF ANTENNA | | MATCHING CAPACITANCE [pF] |
|---|---|---|---|---|---|---|---|
| | εr | μr | σ [/Ωm] | tan σ [at 4GHz] | le [mm] | gf [mm] | |
| FIG.12 MAGNETIC SUBSTANCE | 1.0 | 4.0 | 0.1 | 8.0e-7 | 15.0 | 5.0 | Cs:0.4 |
| FIG.13 MAGNETIC SUBSTANCE | 1.0 | 4.0 | 1.0 | 8.0e-6 | 15.0 | 7.5 | Cs:0.5 |
| FIG.14 MAGNETIC SUBSTANCE | 1.0 | 4.0 | 10.0 | 8.0e-5 | 15.0 | 7.5 | Cs:1.5+Cp:0.5 |

WIDE BAND ANTENNA

CROSS-REFERENCE TO RELATED APPLICATIONS

This application is a continuation of U.S. application Ser. No. 10/395,078 filed Mar. 25, 2003, U.S. Pat. No. 6,914,561 and further is based upon and claims the benefit of priority from the prior Japanese Patent Application No. 2002-106417 filed Apr. 9, 2002, the entire contents of each of which are incorporated herein by reference.

BACKGROUND OF THE INVENTION

1. Field of the Invention

The present invention relates to a thin-type wideband antenna used in a communication system that requires an ultra wideband and miniature antenna, such as a broadband Personal Area Network (PAN) using the Ultra Wide-Band (UWB) technique, for example.

2. Description of Related Art

To implement the broadband PAN using the UWB technique an ultra wideband and miniature antenna are utilized. The so-called patch antenna (thin-type antenna) answers the requirement especially for the thin-type. The patch antenna is constructed of an insulating substance interposed between a radiation conductor and a reference conductor which are in facing relationship with respect to each other.

The shape of the radiation conductor is not especially restricted, however in general, a rectangular shape or circular is used. Generally, the thickness of the insulating substance interposed between the radiation conductor and the reference conductor is selected to less than 1/10 of the wavelength of the radio frequency. Accordingly, it can be made extremely thin.

The patch antenna can be manufactured comparably easily through the etching processing of an insulating substrate with copper layers spread on both the sides thereof. That is, the patch antenna is comparably easy of manufacturing, and it has an advantage of easiness in integration with a circuit board.

However, the patch antenna has a sharp operational bandwidth. Therefore, it is not suitable for the PAN system that requires a wider operational bandwidth. Suppose a patch antenna formed by using an insulating substance having a relative dielectric constant $\in r=4$, conductivity $\sigma=0.003$ [/Ωm], and thickness t=2 mm as an interposition, and facing a square reference conductor whose length of the side is 68 mm and a square radiation conductor whose length of the side is 15 mm so that the centers of the two coincide. In this patch antenna, the center of the reference conductor and the center of the radiation conductor are connected with a short-circuiting pin, and a feeding point is provided at a position 3 mm remote from the short-circuiting pin. The simulation result of this patch antenna is as follows:

FIG. 19A is a Smith chart illustrating the impedance characteristic of the patch antenna having the above parameters, and FIG. 19B illustrates the VSWR characteristic of the same. FIG. 20A illustrates a radiation pattern characteristic obtained by radiating a signal of the frequency f=3.5 GHz, FIG. 20B illustrates a radiation pattern characteristic obtained by radiating a signal of the frequency f=4 GHz, and FIG. 20C illustrates a radiation pattern characteristic obtained by radiating a signal of the frequency f=4.5 GHz.

As understood from FIG. 19, when the operational bandwidth is regarded as a bandwidth, in which the VSWR is less than 2, only a relative bandwidth of about 3% can be obtained. As understood from the comparison of FIG. 20A, FIG. 20B, and FIG. 20C, the case using the signal of the frequency 4 GHz achieved a satisfactory gain, however both the case using the signal of 3.5 GHz and the case using the signal of 4.5 GHz could not achieve a sufficient gain.

Thus, there has been a desire for a thin-type wideband antenna with a lowered standing wave ratio that follows the advantage of easiness in production and easiness in integration with a circuit board, and so forth that the patch antenna has, and which is applicable to a communication system that requires a wider bandwidth, such as the PAN system.

SUMMARY OF THE INVENTION

In view of the above circumstances, the invention provides a thin-type wideband antenna with a lowered standing wave ratio.

According to one aspect of the present invention, the wideband antenna includes a reference conductor and a radiation conductor that are connected with a feeder line for transmitting power, at least parts of which are disposed so as to face each other. And, the antenna has a substance whose conductivity is about 0.1 through 10 in the operational radio frequency interposed between the parts that the reference conductor and the radiation conductor face each other.

According to the wideband antenna as mentioned above, the substance having the conductivity of about 0.1 through 10 is interposed between the reference conductor and the radiation conductor, and thereby the antenna appropriately leaks signals into the substance between the reference conductor and the radiation conductor, which makes it possible to achieve a wideband antenna with a sufficient gain and lowered standing wave ratio.

According to another aspect of the present invention, the thin-type wideband antenna includes a reference conductor and a radiation conductor that are connected with a feeder line for transmitting a power, which are disposed in close proximity and substantially in parallel so as to face each other. And, the antenna has a magnetic substance whose relative permeability is more than 1 through about 8 in the operational radio frequency interposed between the reference conductor and the radiation conductor.

According to the above thin-type wideband antenna, the magnetic substance whose relative permeability is more than 1 through about 8 in the operational radio frequency is interposed between the reference conductor and the radiation conductor, which makes it possible to achieve a thin-type wideband antenna with a sufficient gain.

And, the impedance matching can easily be achieved by connecting the matching capacitor in series or in parallel, or in series and parallel to the feeding point.

Other and further objects, features and advantages of the invention will appear more fully from the following description.

BRIEF DESCRIPTION OF THE DRAWINGS

FIG. 2 illustrates parameters for the simulation of the wideband antenna illustrated in FIG. 1;

FIG. 3 illustrates a simulation result when a dielectric whose conductivity $\sigma$ is 0.1 [/Ωm] is used as the interposition 3 of the wideband antenna illustrated in FIG. 1, in which

FIG. 4 illustrates a simulation result when a dielectric whose conductivity σ is 1.0 [/Ωm] is used as the interposition 3 of the wideband antenna illustrated in FIG. 1, in which

FIG. 5 illustrates a simulation result when a dielectric whose conductivity σ is 10.0 [/Ωm] is used as the interposition 3 of the wideband antenna illustrated in FIG. 1, in which

FIG. 8 illustrates radiation pattern characteristics when the relative permeability μr of the interposition 3 of the wideband antenna illustrated in FIG. 6 is 4.0, in which

FIG. 9 illustrates VSWR characteristics when magnetic substances having different relative permeability are used as the interposition 3 of the wideband antenna illustrated in FIG. 6, in which

FIG. 11 lists parameters for the simulation of the wideband antenna illustrated in FIG. 10;

FIG. 12 illustrates a simulation result when a magnetic substance whose conductivity σ is 0.1 [/Ωm] is used as the interposition 3 of the wideband antenna illustrated in FIG. 10, in which

FIG. 13 illustrates a simulation result when a magnetic substance whose conductivity σ is 1.0 [/Ωm] is used as the interposition 3 of the wideband antenna illustrated in FIG. 10, in which

FIG. 14 illustrates a simulation result when a magnetic substance whose conductivity σ is 10.0 [/Ωm] is used as the interposition 3 of the wideband antenna illustrated in FIG. 10, in which

FIG. 20 illustrates radiation pattern characteristics of a conventional thin-type antenna using a general insulating material as the interposition, in which

DETAILED DESCRIPTION OF THE PREFERRED EMBODIMENTS

First Embodiment

The wideband antenna of the first embodiment is created with attention to the conductivity σ of a substance being interposed between a reference conductor and a radiation conductor. The first embodiment uses the substance whose conductivity σ is within a specific range of comparably large conductivities. The antenna appropriately leaks signals into the substance between the reference conductor and the radiation conductor to bear a loss, and thereby reduces reflected waves to lower the standing wave ratio, and to widen the operational bandwidth.

The wideband antenna of this invention is applicable to various antennas that are formed with a substance having a specific conductivity interposed between the reference conductor and the radiation conductor. Hereunder, an example will be explained, in which the invention is applied to the so-called patch antenna.

Figure 1A:
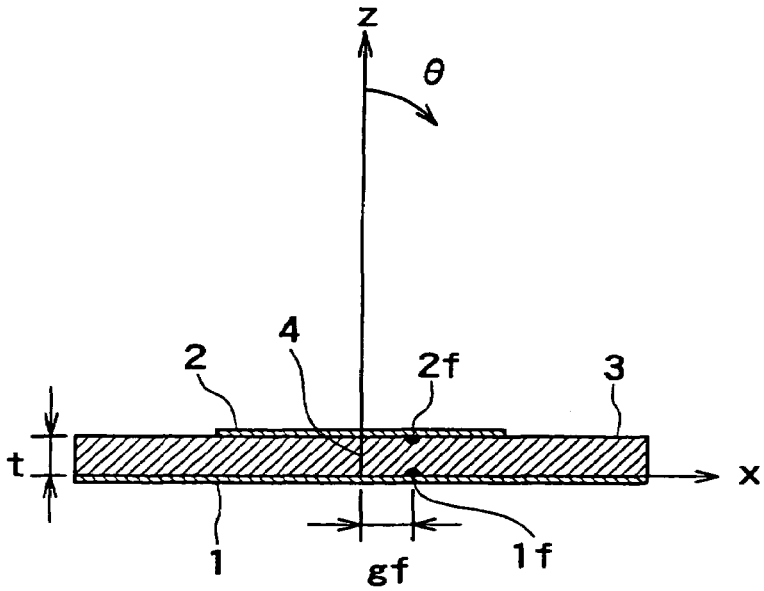
FIG. 1A is a side view explaining a construction of the first embodiment of a wideband antenna according to the present invention.
Figure 1B:
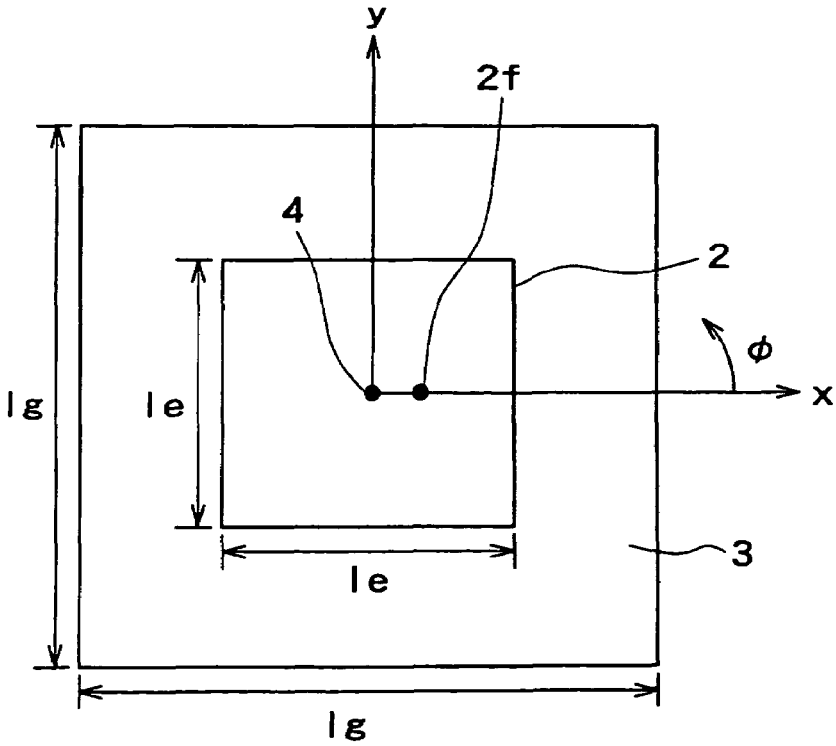
FIG. 1B is a top view explaining the same.

FIG. 1 is a chart that explains a construction of the wideband antenna of the first embodiment. In FIG. 1, FIG. 1A is a side view of the wideband antenna of the first embodiment, and FIG. 1B is a top view of the same.

As shown in FIG. 1A, the wideband antenna of the first embodiment is formed such that a ground conductor or "reference conductor" 1 and a radiation conductor 2 are disposed to face each other, and a substance whose conductivity σ is more than about 0.1 [/Ωm] in the operational radio frequency is interposed as an interposition 3 between the reference conductor 1 and the radiation conductor 2. In the first embodiment, the interposition 3 is a dielectric with a high loss, and the thickness thereof is about 2 mm, for example.

In the first embodiment, the conductivity σ of the interposition 3 being a dielectric is needed to be about 0.1 [/Ωm] and higher, however, the range of the conductivity that gives a preferable characteristic in a practical use is about 0.1 [/Ωm] through 10.0 [/Ωm]. Various dielectrics having the conductivity in this rage can be used as the interposition 3.

As shown in FIG. 1B, in the thin-type wideband antenna of the first embodiment, the reference conductor 1 is formed in a square whose length of the side is lg, and the radiation conductor 2 is formed in a square whose length of the side is le. The reference conductor 1 and the radiation conductor 2 are placed to face each other so that the positions of the centers thereof coincide.

As shown in FIG. 1A and FIG. 1B, the thin-type wideband antenna of the first embodiment further includes a short-circuiting pin 4 that connects the center (the intersection of the two diagonal lines) of the reference conductor 1 and the center (the intersection of the two diagonal lines) of the radiation conductor 2. And at a position gf mm remote from the short-circuiting pin 4, it also includes a ground feeding point 1*f* on the side of the reference conductor 1 and a signal feeding point 2*f* on the side of the radiation conductor 2. Here, the short-circuiting pin 4 is mainly to suppress the excitations of higher modes.

With regard to the wideband antenna thus formed, the simulation result of the impedance characteristic and the overall characteristic in each conductivity σ will be explained, in which the conductivities σ of the dielectric substance used as the interposition 3 are assumed as 0.1 [/Ωm], 1.0 [/Ωm], and 10.0 [/Ωm].

FIG. 2 lists parameters for the simulation of the thin-type wideband antenna of the first embodiment. As shown in FIG. 2, the first embodiment uses three types of dielectric substances as the interposition 3 interposed between the reference conductor 1 and the radiation conductor 2, in which the relative dielectric constants ∈r are all 4.0, and the relative permeability μr and the dimension of the antenna are common to all, but the conductivities σ take different values among 0.1 [/Ωm], 1.0 [/Ωm], and 10.0 [/Ωm]. The simulation using these parameters was made with the wideband antenna of the first embodiment. However, the length of the side of the reference conductor 1 and the interposition 3 was lg=68 mm.

In FIG. 2, tan δ is the dependent parameter that varies according to variance of the conductivity σ. The tan δ is the ratio of the imaginary part against the real part of the complex dielectric constant ∈ or the complex permeability. It becomes larger as the imaginary part becomes larger, which shows that the loss increases.

In FIG. 2, the matching capacitance shows the value of the capacitor used. Cp:0.5 shows that a capacitor of 0.5 pF is connected in parallel to the feeding point, and Cp:1.5 shows that a capacitor of 1.5 pF is connected in parallel to the feeding point.

Figure 3A:
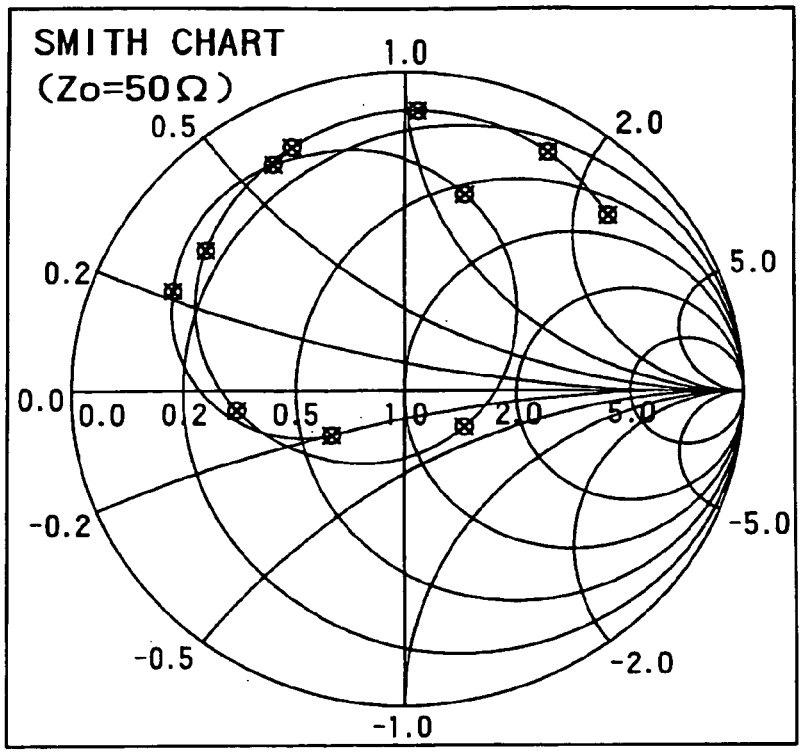
FIG. 3A shows the Smith chart, and FIG. 3B the VSWR characteristic.
Figure 3B:
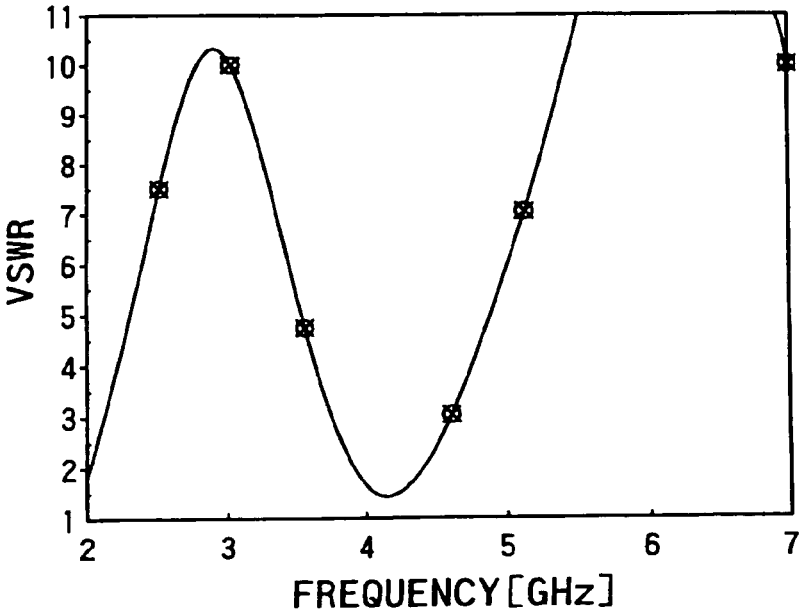

And, the simulation results corresponding to the parameters are found in FIG. 3, FIG. 4, and FIG. 5, as shown on the left end of FIG. 2. That is, FIG. 3 illustrates the Smith chart (FIG. 3A) showing the impedance characteristic, and the VSWR characteristic (FIG. 3B) showing the matching characteristic, when a dielectric having the conductivity σ=0.1 [/Ωm] is used as the interposition 3.

Figure 4A:
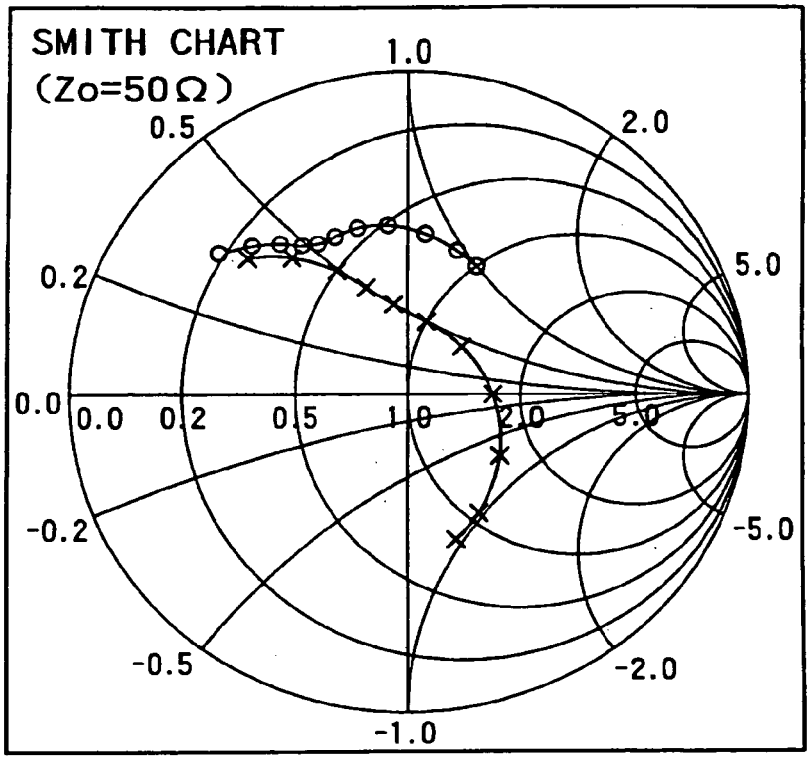
FIG. 4A shows the Smith chart, and FIG. 4B the VSWR characteristic.
Figure 4B:
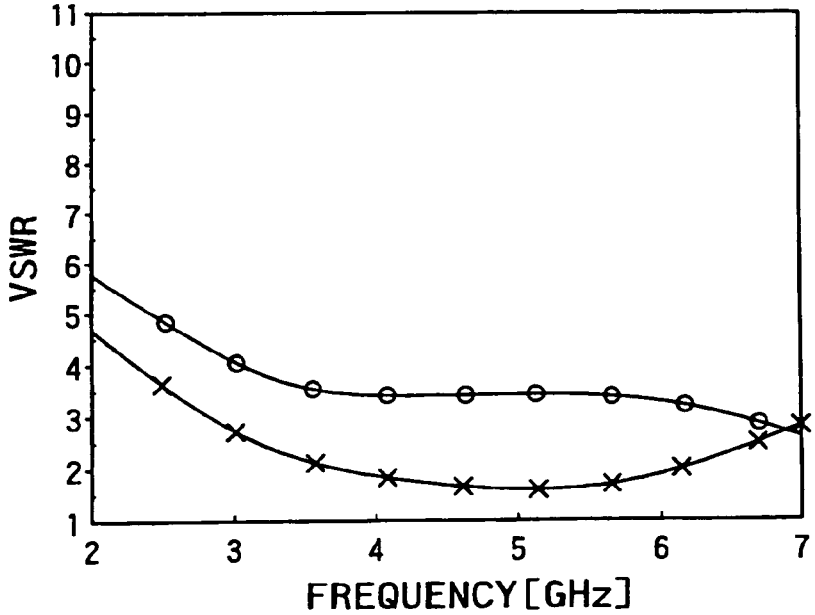
Figure 5A:
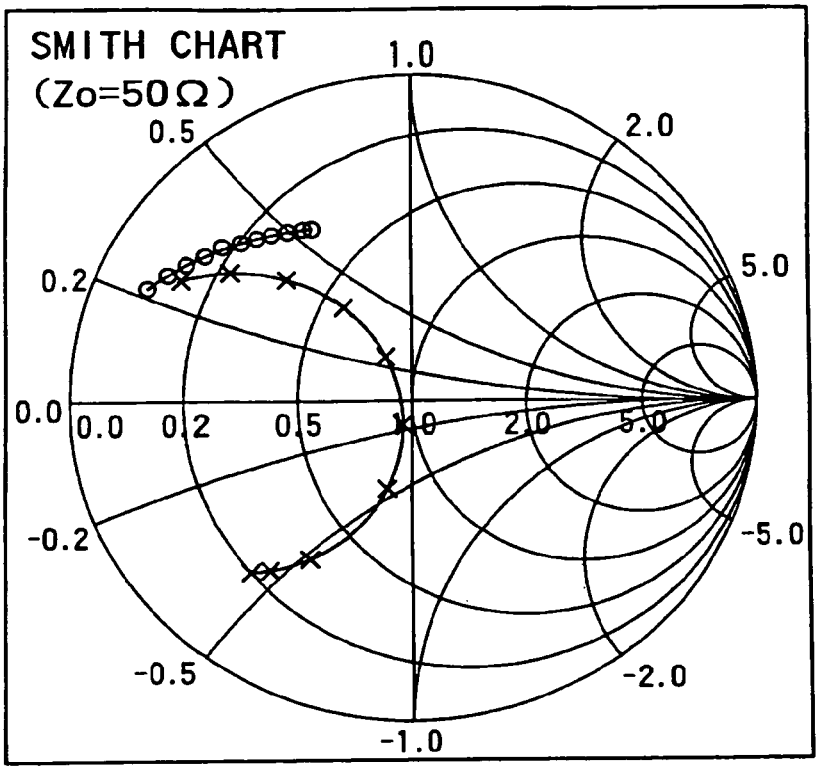
FIG. 5A shows the Smith chart, and FIG. 5B the VSWR characteristic.
Figure 5B:
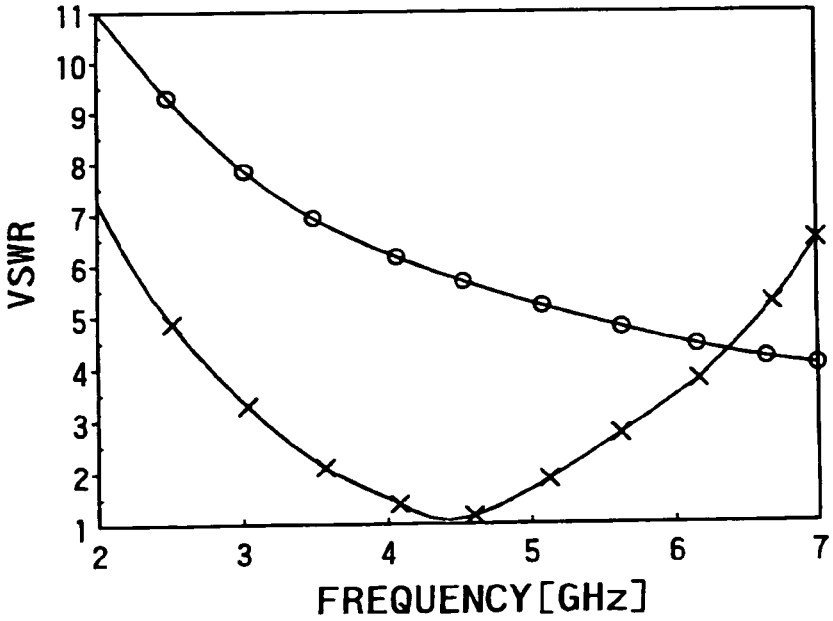

And, FIG. 4 illustrates the Smith chart (FIG. 4A) showing the impedance characteristic, and the VSWR characteristic (FIG. 4B) showing the matching characteristic, when a dielectric having the conductivity σ=1.0 [/Ωm] is used as the interposition 3. FIG. 5 illustrates the Smith chart (FIG. 5A) showing the impedance characteristic, and the VSWR characteristic (FIG. 5B) showing the matching characteristic, when a dielectric having the conductivity σ=10.0 [/Ωm] is used as the interposition 3.

As shown in FIG. 2, the matching capacitor is not used when the dielectric having the conductivity σ=0.1 [/Ωm] is used as the interposition 3. However, the matching capacitors are used when the dielectric having the conductivity σ=1.0 [/Ωm] and the dielectric having the conductivity σ=10.0 [/Ωm] are used as the interposition 3.

In order to display the effect of the matching, FIG. 4 and FIG. 5 show both the simulation results by the lines plotted with round marks, when the matching capacitors are not used, and the simulation results by the lines plotted with cross marks, when the matching capacitors are used.

It is confirmed from the Smith chart and the VSWR characteristic illustrated in FIG. 3 that about 700 MHz (relative bandwidth: about 15%) is attained around 4 GHz as the operational bandwidth in case of the conductivity σ=0.1 [/Ωm], assuming that the bandwidth within which the VSWR is less than 3 is the operational bandwidth. It is also confirmed that about 500 MHz is attained around 4 GHz as the operational bandwidth, assuming that the bandwidth within which the VSWR is less than 2 is the operational bandwidth.

As it is found from FIG. 4 and FIG. 5, when the interposition 3 having the conductivity σ=1.0 [/Ωm] and the interposition 3 having the conductivity σ=10.0 [/Ωm] are used, to connect the matching capacitor to the feeding point will greatly improve the matching characteristic. When the operational bandwidth is regarded as the bandwidth within which the VSWR is less than 3, a wideband characteristic covering the relative bandwidth 50% at least can be realized. When the operational bandwidth is regarded as the bandwidth within which the VSWR is less than 2, the bandwidth of about 2 GHz can be secured as the operational bandwidth.

Figure 19A:
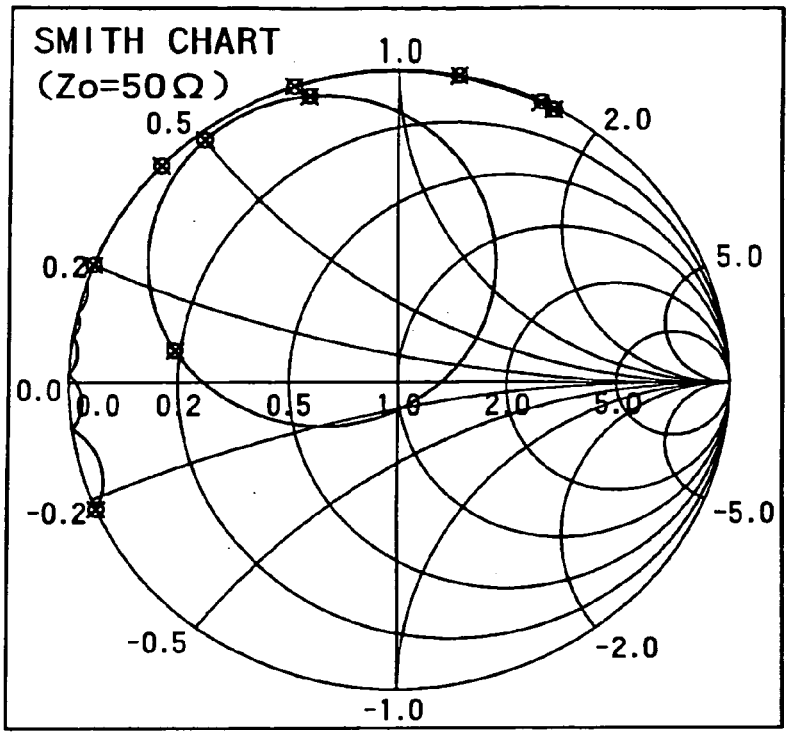
FIG. 19A illustrates a Smith chart of a conventional thin-type antenna using a general insulating material as the interposition.
Figure 19B:
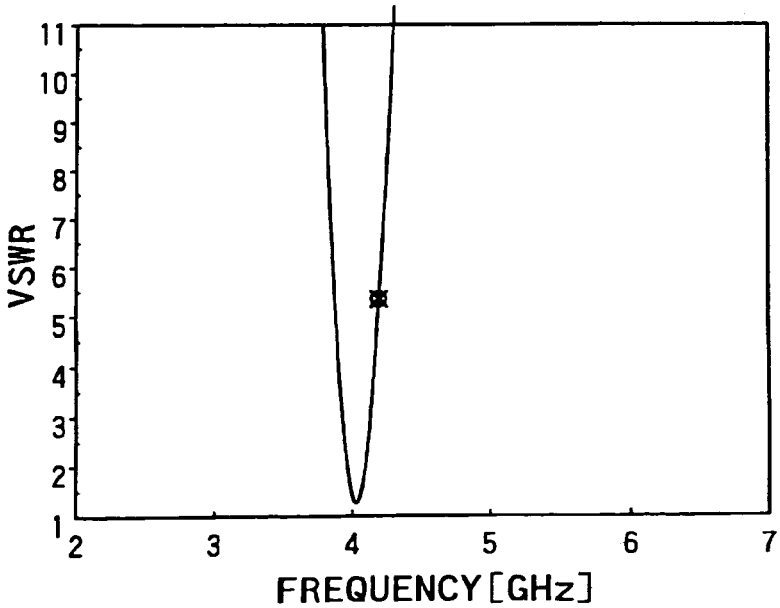
FIG. 19B is a VSWR characteristic of the same.

From the comparison of the simulation results (FIG. 3 through FIG. 5) of the first embodiment against the Smith chart (FIG. 19A) and the VSWR characteristic (FIG. 19B) of the conventional patch antenna using the insulating substance having the relative dielectric constant ∈r=4, conductivity σ=0.003 [/Ωm], and thickness t=2 mm as the interposition 3, it is clearly confirmed that the wideband antenna of the first embodiment achieves a sufficient widening of the operational bandwidth.

Thus, the use of a substance having a specific conductivity as the interposition 3 (dielectric substance in the first embodiment) realizes a very thin-type wideband antenna with a lowered standing wave ratio.

Second Embodiment

The wideband antenna of the second embodiment is created with attention to the relative permeability μr of a substance being interposed between the reference conductor and the radiation conductor. The second embodiment uses a magnetic substance as the interposition, of which relative permeability μr is within a specific range, thereby further widening the operational bandwidth of the wideband antenna.

Figure 6A:
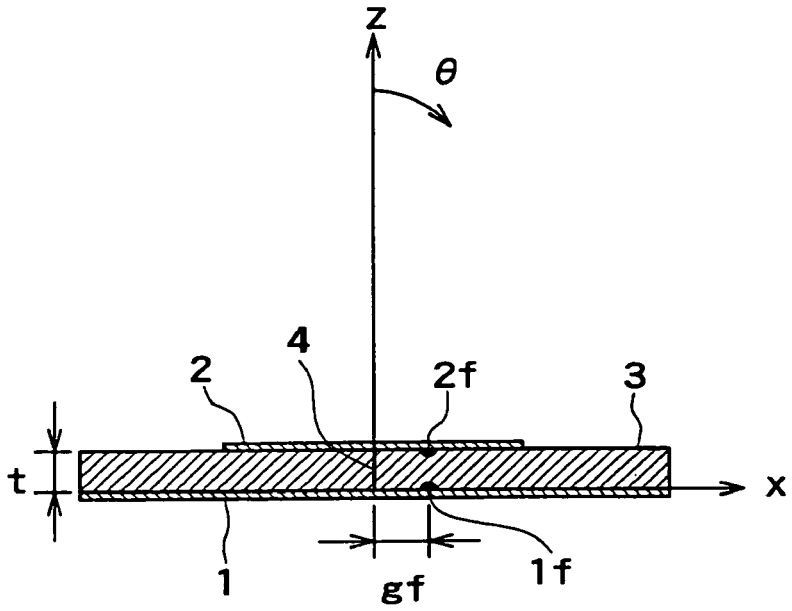
FIG. 6A is a side view explaining a construction of the second embodiment of a wideband antenna according to the invention.
Figure 6B:
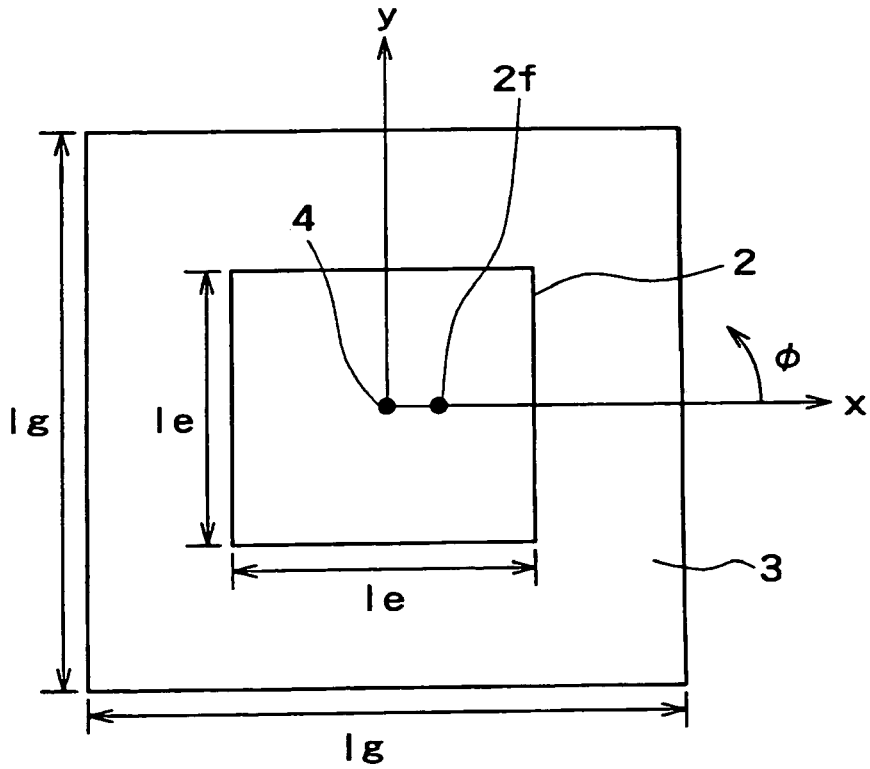
FIG. 6B is a top view explaining the same.

FIG. 6 is a chart explaining the construction of a thin-type wideband antenna relating to the second embodiment, in which FIG. 6A is a side view of the thin-type wideband antenna of this embodiment, and FIG. 6B is a top view explaining the same. As shown in FIG. 6, the thin-type wideband antenna of the second embodiment is made up in the same manner as the wideband antenna of the first embodiment.

However, the wideband antenna of the second embodiment has been created from a novel idea of using a magnetic substance instead of a dielectric substance as the interposition 3. The wideband antenna of the second embodiment uses a magnetic substance whose relative permeability is more than 1.0 through about 8.0; thereby, it utilizes the wavelength shortening effect as it stands, and realizes a further widening of the operational bandwidth.

[Simulation Result in Using a Magnetic Substance as the Interposition 3]

The simulation result of a thin-type wideband antenna relating to the second embodiment will be explained. The wideband antenna possesses the construction as illustrated in FIG. 6, uses a magnetic substance as the interposition 3, which has a relative permeability μr=4.0, relative dielectric constant ∈r=1.0, conductivity σ=0.003 [/Ωm], and thickness t=2 mm, and includes the parameters: the length of one side lg=68 mm of the reference conductor 1, the length of one side le=15 mm of the radiation conductor 2, and the gap gf=3.0 mm between the short-circuiting pin 4 and the feeding point 1*f*.

Figure 7:
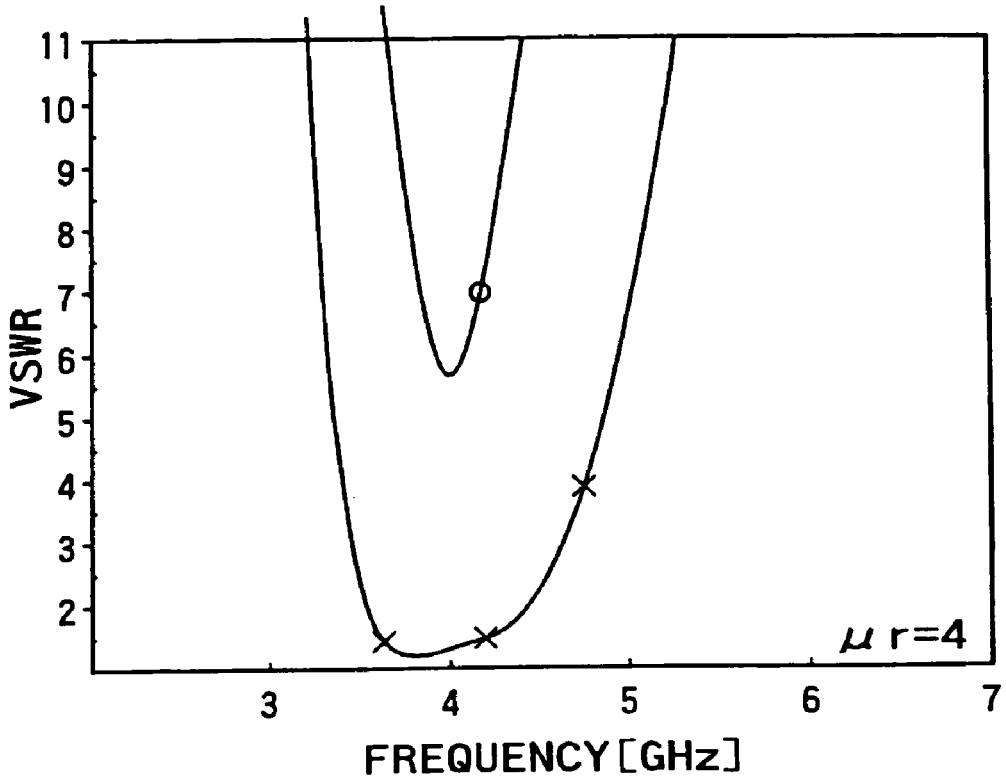
FIG. 7 illustrates a VSWR characteristic when a magnetic substance having the relative permeability μr=4.0 is used as the interposition 3 of the wideband antenna illustrated in FIG. 6.

FIG. 7 illustrates a VSWR characteristic of the thin-type wideband antenna of the second embodiment that uses the magnetic substance having the relative permeability μr=4.0 as the interposition 3. In FIG. 7, the upper curve with a round mark attached, showing that lower limit of the VSWR is about 6, represents the raw VSWR characteristic (VSWR characteristic of the antenna itself) of the thin-type wideband antenna of the second embodiment; and the lower curve with cross marks attached, showing that lower limit of the VSWR is about 1, represents the VSWR characteristic of the thin-type wideband antenna of the second embodiment, when a matching capacitor of 0.35 pF is connected in series to the feeding point.

As seen from FIG. 7, the wideband antenna without using the capacitor has a resonance frequency of about 4 GHz. However, the imaginary part of the impedance does not become completely zero, and the antenna will not match with 50 Ω being the normalized impedance, as far as it remains intact.

And, a capacitor of 0.35 pF is connected in series to the feeding point to make the matching. Thereby, the VSWR characteristic is improved to a great degree. When the operational bandwidth is regarded as the bandwidth within which the VSWR is lower than 2, the antenna attains the relative bandwidth of 22%. In general, the conventional construction using a dielectric substance barely obtains the relative bandwidth of some percents, and this confirms the effect of widening the bandwidth owing to the invention.

Figure 8A:
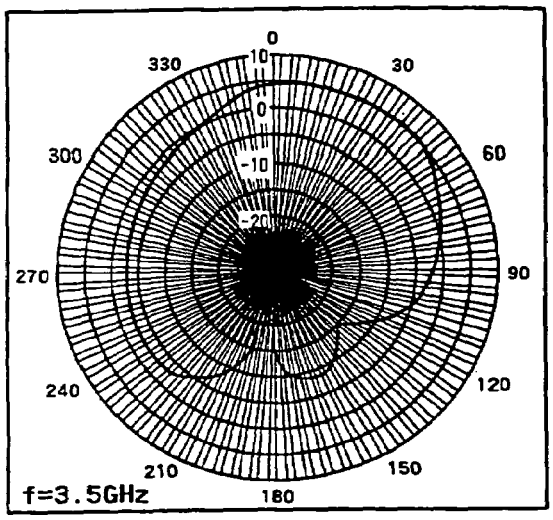
FIG. 8A shows a pattern with the frequency 3.5 GHz, FIG. 8B a pattern with the frequency 4 GHz, and FIG. 8C a pattern with the frequency 4.5 GHz.
Figure 8B:
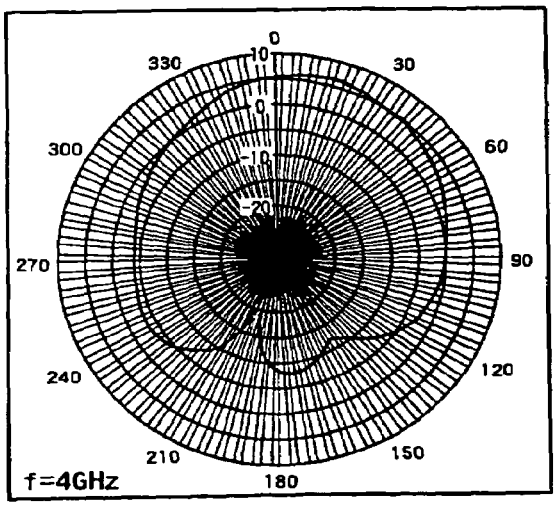
Figure 8C:
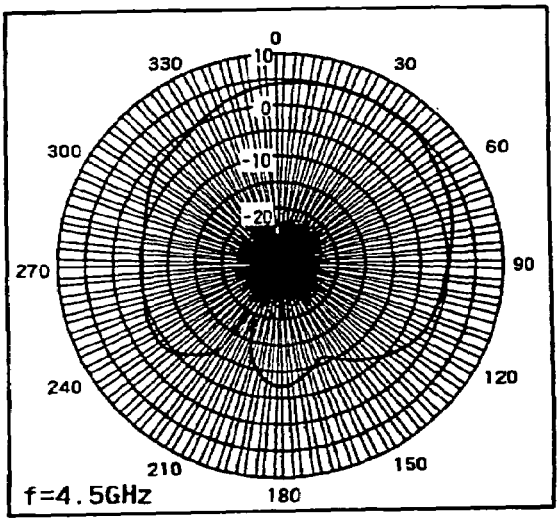

FIG. 8 illustrates radiation pattern characteristics (θ pattern in the plane ϕ=0°) of the thin-type wideband antenna of the second embodiment that uses the magnetic substance having the relative permeability μr=4.0 as the interposition 3. In FIG. 8, FIG. 8A shows a radiation pattern when a signal of which frequency is 3.5 GHz is radiated, FIG. 8B a radiation pattern when a signal of which frequency is 4.0 GHz is radiated, and FIG. 8C a radiation pattern when a signal of which frequency is 4.5 GHz is radiated. As seen from FIG. 8A through FIG. 8C, the antenna attains the gain of about 5 dBi over a wide range covering 3.5 GHz to 4.5 GHz.

Figure 9A:
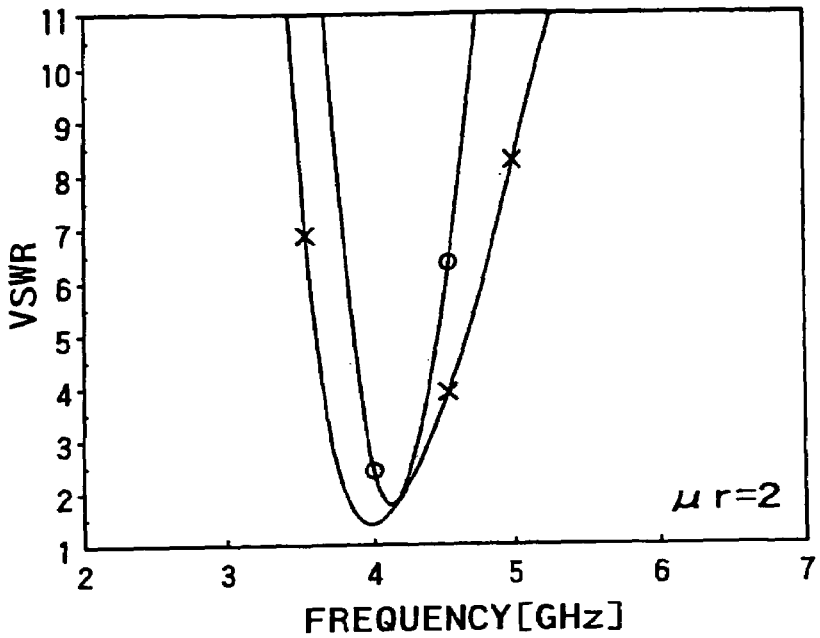
FIG. 9A shows the VSWR characteristic when the relative permeability μr is 2.0.
Figure 9B:
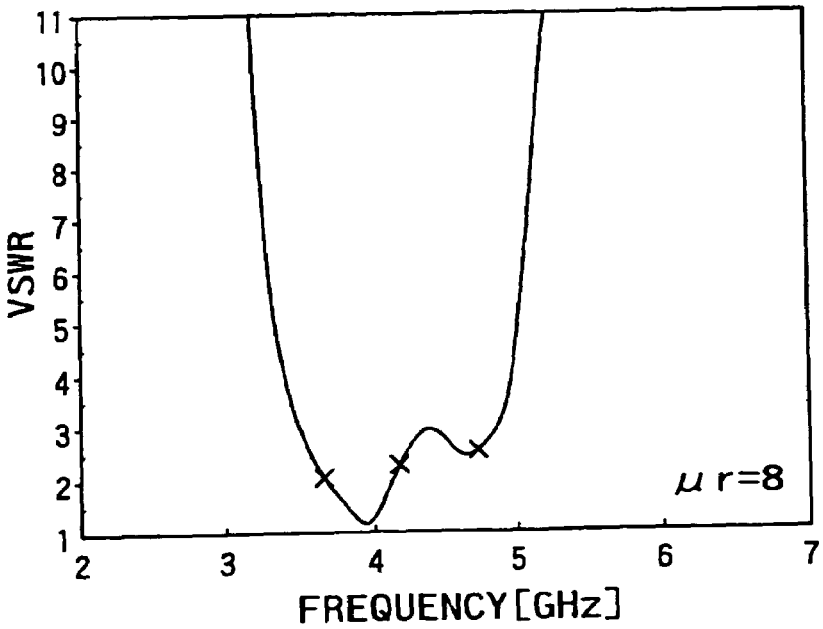
FIG. 9B shows the VSWR characteristic when the relative permeability μr is 8.0.

And, the VSWR characteristics of the thin-type wideband antennas are shown in FIG. 9A and FIG. 9B, which use a magnetic substance having the relative permeability μr=2.0 and a magnetic substance having the relative permeability μr=8.0 as the interposition 3.

FIG. 9A illustrates the VSWR characteristic of the thin-type wideband antenna of the second embodiment that uses the magnetic substance having the relative permeability μr=2.0 as the interposition 3. In FIG. 9A, the upper curve with round marks attached, showing that lower limit of the VSWR is about 2, represents the raw VSWR characteristic (VSWR characteristic of the antenna itself) of the thin-type wideband antenna of the second embodiment; and the lower curve with cross marks attached, showing that lower limit of the VSWR is about 1, represents the VSWR characteristic of the thin-type wideband antenna of the second embodiment, when a matching capacitor of 0.75 pF is connected in series to the feeding point.

As seen from FIG. 9A, the wideband antenna using the magnetic substance having the relative permeability μr=2.0 as the interposition 3 attains the relative bandwidth of about 10% around the center frequency 4 GHz, assuming that the operational bandwidth is the bandwidth within which the VSWR is less than 2.

FIG. 9B illustrates the VSWR characteristic of the thin-type wideband antenna of the second embodiment that uses the magnetic substance having the relative permeability μr=8.0 as the interposition 3. In FIG. 9B, the raw VSWR characteristic (VSWR characteristic of the antenna itself) of the thin-type wideband antenna of the second embodiment is not shown, and the curve with cross marks attached, showing that lower limit of the VSWR is about 1, represents the VSWR characteristic of the thin-type wideband antenna of the second embodiment, when a matching capacitor of 0.19 pF is connected in series to the feeding point. Also in this case, the wideband antenna attains the relative bandwidth of about 13% around the center frequency 4 GHz, assuming that the operational bandwidth is the bandwidth within which the VSWR is less than 2.

In any cases of the relative permeability μr=2.0, 4.0, and 8.0, it is confirmed that the antenna secures a comparably wide operational bandwidth. Here, the operational bandwidth is assumed as the bandwidth within which the VSWR is less than 2. However, if it is assumed as the bandwidth within which the VSWR is less than 3, the antenna will secure a wider operational bandwidth in any cases of the above.

In case of the relative permeability μr=8.0, there is a tendency that higher order modes degenerate, and the stability of the radiation directionality is conceivably deteriorated. Therefore, it is difficult to use a magnetic substance having the relative permeability μr more than 8.0 as the interposition 3. Accordingly, the usable range of the relative permeability μr of a magnetic substance as the interposition 3 should be more than 1.0 through about 8.0 ($1.0<\mu r\leqq 8.0$).

Figure 20A:
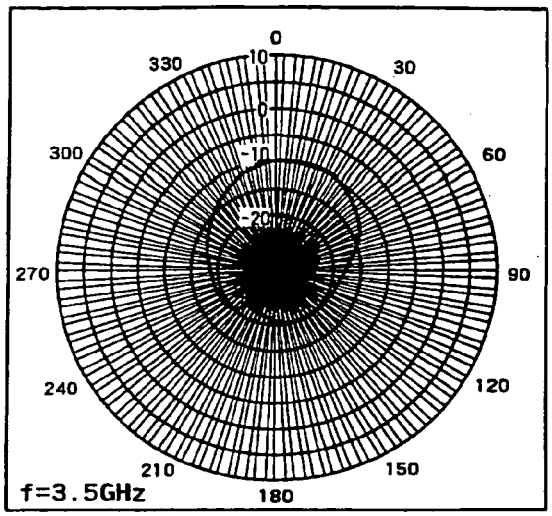
FIG. 20A shows a pattern with the frequency 3.5 GHz, FIG. 20B a pattern with the frequency 4 GHz, and FIG. 20C a pattern with the frequency 4.5 GHz.
Figure 20B:
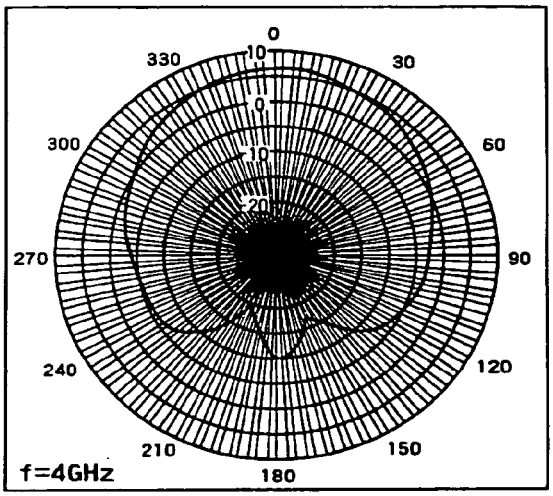
Figure 20C:
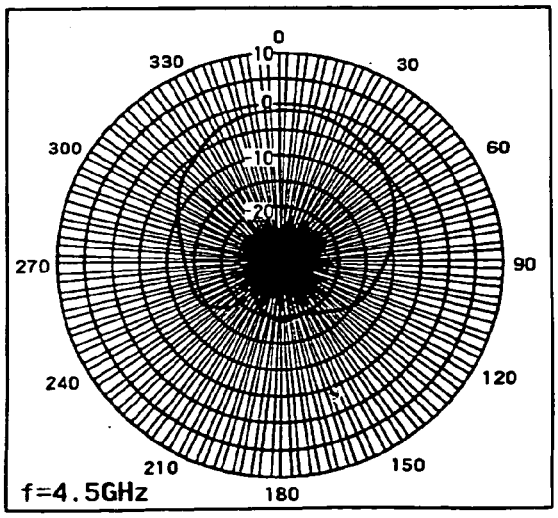

The following points will become clear, when the simulation results illustrated in FIG. 7, FIG. 8, and FIG. 9 of the thin-type wideband antenna of the second embodiment using the magnetic substance as the interposition 3 are compared with the simulation results illustrated in FIG. 19 and FIG. 20 of the conventional patch antenna using the traditionally used insulating material as the interposition 3.

In consideration of the application field that requires a sufficient gain and a stable radiation pattern even with a narrow bandwidth, the conventional patch antenna using the traditional insulating material as the interposition 3 is able to achieve the objective satisfactorily, as shown in FIG. 19 and FIG. 20.

However, in consideration of a new application field that prefers a wider operational bandwidth and omni-directionality, such as the PAN system using the UWB technique that has attracted much attention in recent years, any one but the thin-type wideband antenna of the second embodiment using the magnetic substance having the relative permeability of more than 1.0 through about 8.0 ($1.0<\mu r\leqq 8.0$) as the interposition 3 will not substantially satisfy the required characteristics, as shown in FIG. 7, FIG. 8, and FIG. 9.

That is, the conventional patch antenna had to attain a high gain in order for satisfactory communications, and had to use the insulating material as the interposition. However, in order to satisfy the requirements of the new application field such as the PAN system, there was a breakthrough necessary in the conventional technique, which realized a very thin-type wideband antenna based on a new idea of using a magnetic substance as the interposition 3.

Here, the feeding point is located at a position slightly offset from the center of the reference conductor and the radiation conductor for excitation, in case of using either the magnetic substance as the interposition 3 or the conventional insulating material.

Thus, in comparison with the conventional patch antenna using the insulating material as the interposition, the thin-type wideband antenna of the second embodiment using the magnetic substance as the interposition 3 is much more immune to a practical conditions in use, and more difficult to cause inconveniences such that a special care is required.

Thus, the thin-type wideband antenna can be made up with a magnetic substance having the relative permeability of more than 1 through about 8 as the interposition 3, which follows the useful features of the conventional patch antenna as it stands.

Third Embodiment

In the first embodiment, as the interposition 3 interposed between the reference conductor 1 and the radiation conductor 2, a dielectric material having the conductivity σ of about 0.1 [/Ωm] through 10.0 [/Ωm] is used. However, it is conceivable to use a magnetic substance as the interposition, as described in the second embodiment.

Now, a magnetic substance is used as the interposition also in the third embodiment; however, the magnetic substance interposed here is specified not only by the relative permeability μr, which is the case with the second embodiment, but also by the conductivity σ that the magnetic substance interposed between a reference conductor and a radiation conductor possesses.

That is, the wideband antenna of the third embodiment uses a magnetic substance as the interposition between a reference conductor and a radiation conductor, of which conductivity σ belongs to a specific range of comparably large conductivities. Thereby, the antenna appropriately leaks signals into the substance between the reference conductor and the radiation conductor to bear a loss, and thereby widens the operational bandwidth.

Figure 10A:
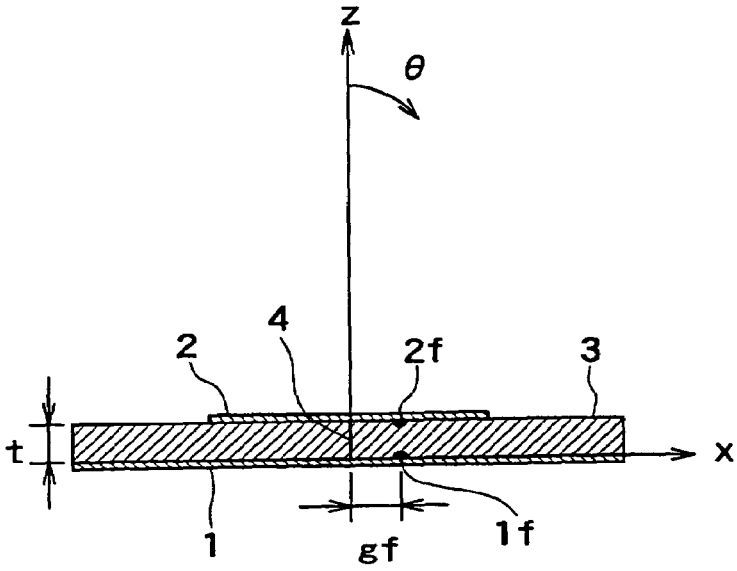
FIG. 10A is a side view explaining a construction of the third embodiment of a wideband antenna according to the invention.
Figure 10B:
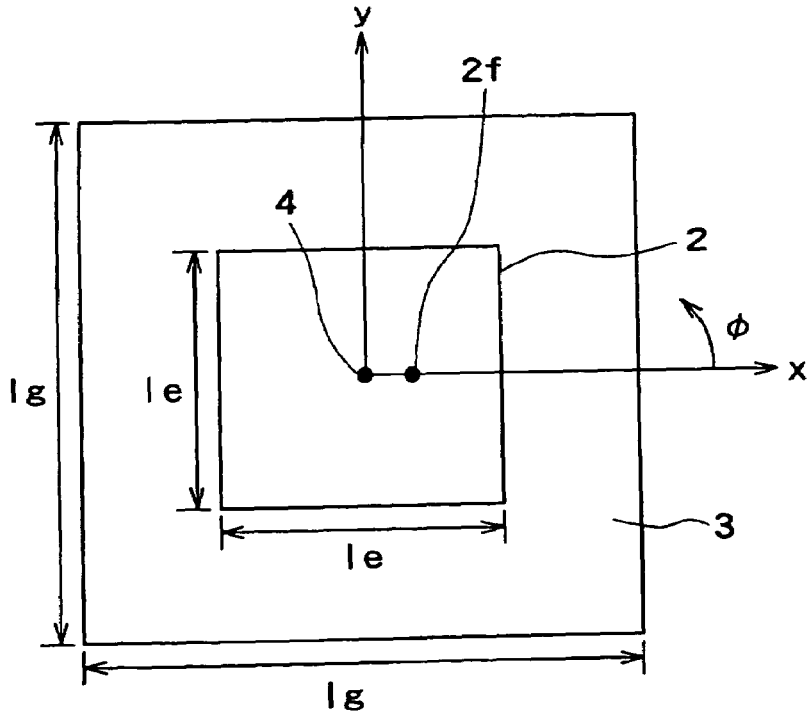
FIG. 10B is a top view explaining the same.

FIG. 10 illustrates the construction of a thin-type wideband antenna of the third embodiment. In the drawing, FIG. 10A is a side view of the wideband antenna, and FIG. 10B is a top view of the same.

As shown in FIG. 10, the thin-type wideband antenna of the third embodiment is formed in the same manner as the wideband antenna of the first embodiment as illustrated in FIG. 1, and the thin-type wideband antenna of the second embodiment as illustrated in FIG. 6, except that the interposition 3 interposed between the reference conductor 1 and the radiation conductor 2 is not a dielectric material, but a magnetic substance having the conductivity σ of about 0.1 [/Ωm] through 10.0 [/Ωm].

With regard to the thin-type wideband antenna of the third embodiment, the simulation results of the impedance characteristic and the overall characteristic in each conductivity σ will be explained, in which the conductivities σ of the magnetic substance used as the interposition 3 are assumed as 0.1 [/Ωm], 1.0 [/Ωm], and 10.0 [/Ωm].

FIG. 11 lists parameters for the simulation of the thin-type wideband antenna of the third embodiment. As shown in FIG. 11, the third embodiment uses three types of magnetic substances as the interposition 3 interposed between the reference conductor 1 and the radiation conductor 2, in which the relative permeability μr are all 4.0, and the relative dielectric constant ∈r and the dimension of the antenna are common to all, but the conductivities σ take different values among 0.1 [/Ωm], 1.0 [/Ωm], and 10.0 [/Ωm]. The simulation using these parameters was made with the wideband antenna of the first embodiment. However, the length of the side of the reference conductor 1 and the interposition 3 was lg=68 mm.

In FIG. 11, tan δ is the dependent parameter that varies according to variance of the conductivity σ, which is already mentioned. And, in FIG. 11, the matching capacitance shows the value of the capacitor used. Cs:0.4 shows that a capacitor of 0.4 pF is connected in series to the feeding point, and Cs:0.5 shows that a capacitor of 0.5 pF is connected in series to the feeding point. And, Cs:1.5+Cp:0.5 in the case of the conductivity σ=10.0 shows that a capacitor of 1.5 pF is connected in series and a capacitor of 0.5 pF is connected in parallel to the feeding point.

Figure 12A:
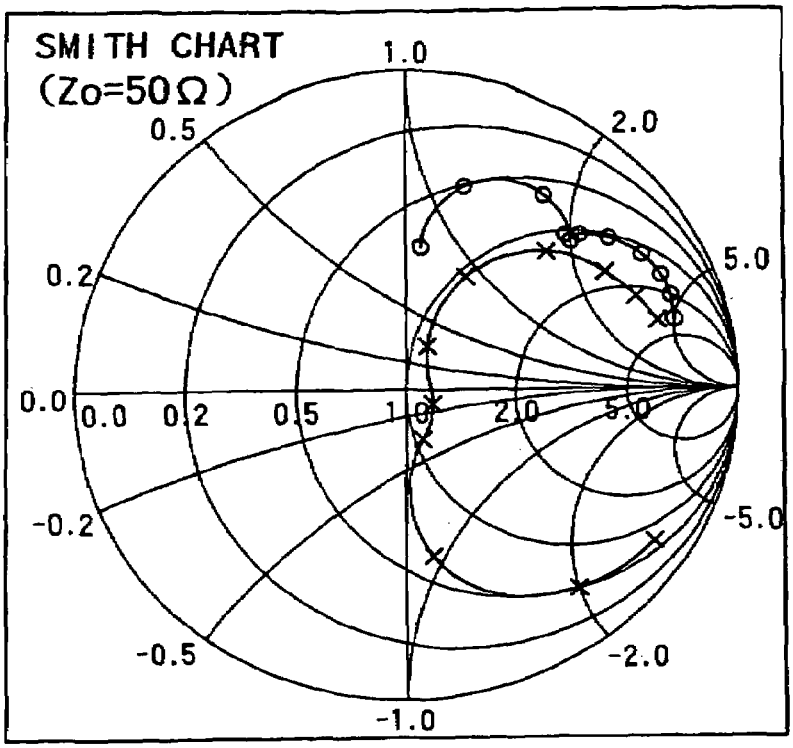
FIG. 12A shows the Smith chart, and FIG. 12B the VSWR characteristic.
Figure 12B:
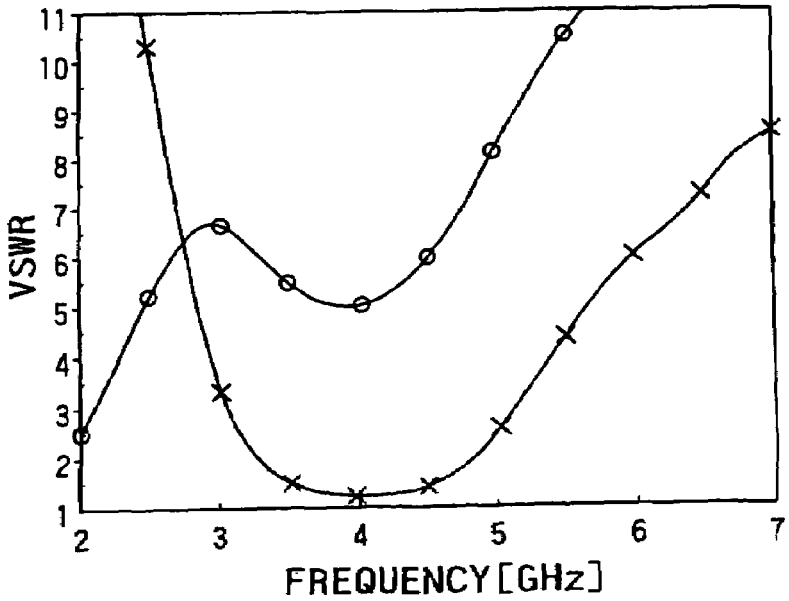

And, the simulation results corresponding to the parameters are found in FIG. 12, FIG. 13, and FIG. 14, as shown on the left end of FIG. 11. That is, FIG. 12 illustrates the Smith chart (FIG. 12A) showing the impedance characteristic, and the VSWR characteristic (FIG. 12B) showing the matching characteristic, when a magnetic substance having the conductivity σ=0.1 [/Ωm] and the relative permeability μr=4.0 is used as the interposition 3.

Figure 13A:
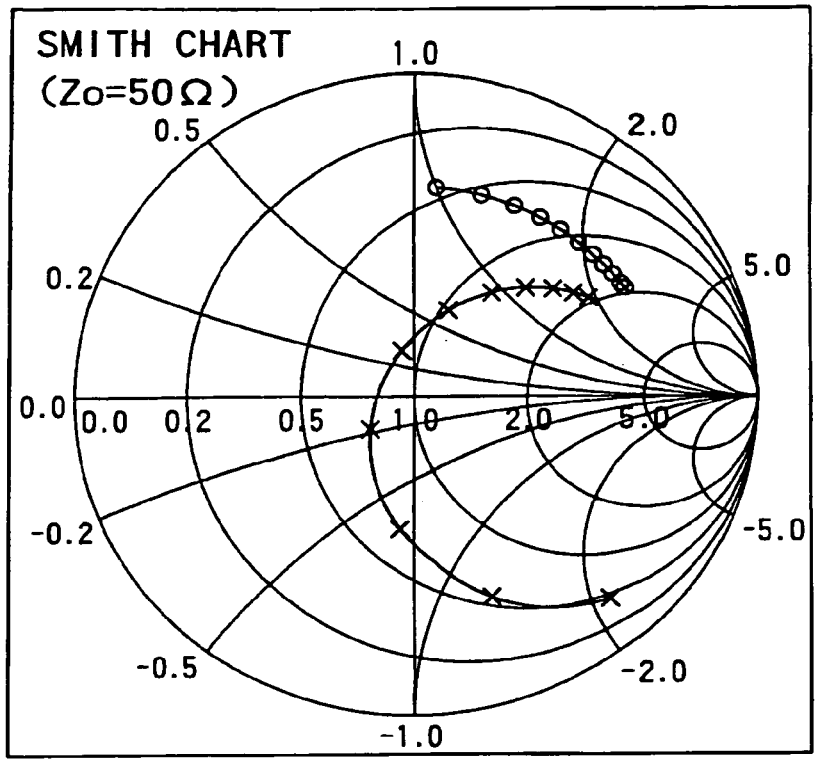
FIG. 13A shows the Smith chart, and FIG. 13B the VSWR characteristic.
Figure 13B:
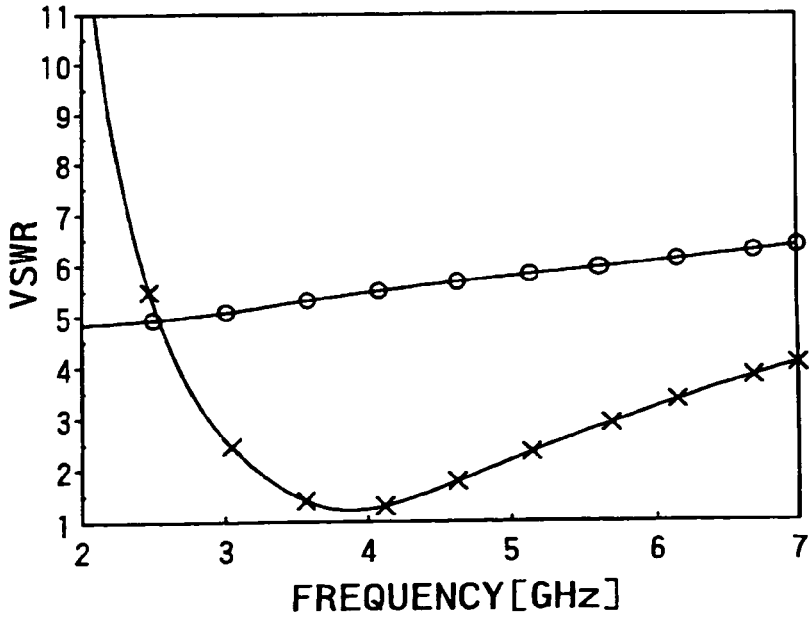
Figure 14A:
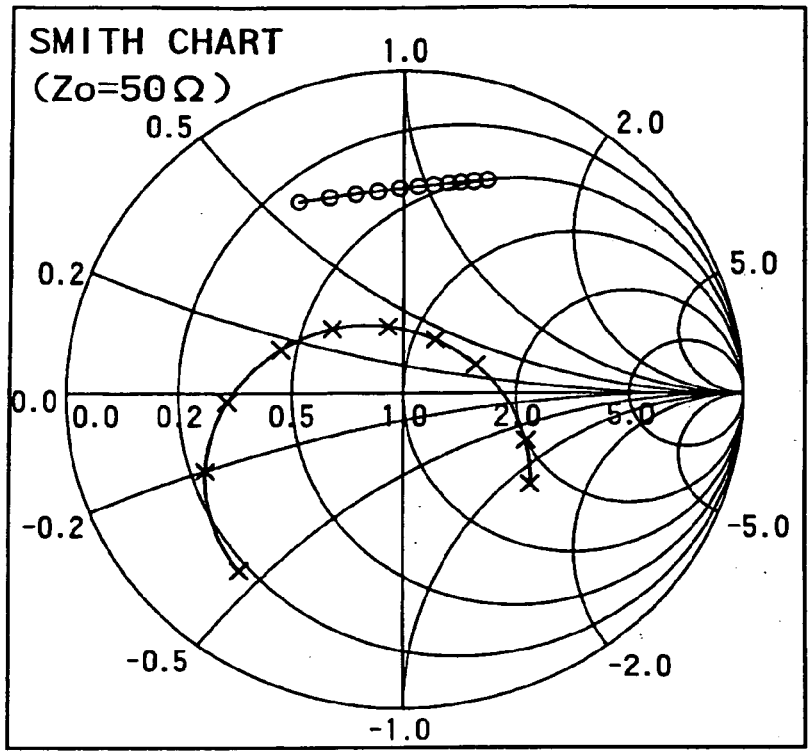
FIG. 14A shows the Smith chart, and FIG. 14B the VSWR characteristic.
Figure 14B:
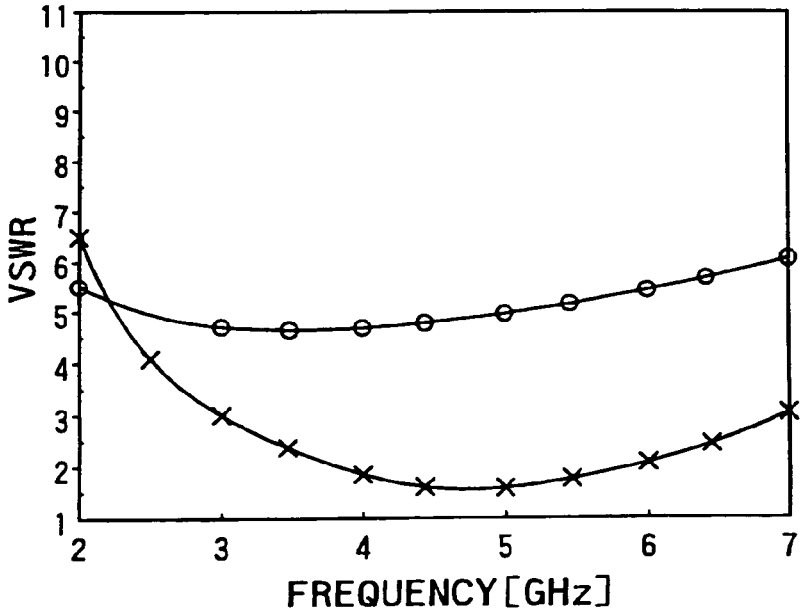

And, FIG. 13 illustrates the Smith chart (FIG. 13A) showing the impedance characteristic, and the VSWR characteristic (FIG. 13B) showing the matching characteristic, when a magnetic substance having the conductivity σ=1.0 [/Ωm] and the relative permeability μr=4.0 is used as the interposition 3. FIG. 14 illustrates the Smith chart (FIG. 14A) showing the impedance characteristic, and the VSWR characteristic (FIG. 14B) showing the matching characteristic, when a magnetic substance having the conductivity σ=10.0 [/Ωm] and the relative permeability μr=4.0 is used as the interposition 3.

In order to display the effect of the matching, FIG. 12, FIG. 13, and FIG. 14 show both the simulation results by the lines plotted with round marks, when the matching capacitors are not used, and the simulation results by the lines plotted with cross marks, when the matching capacitors are used.

It is confirmed from the Smith chart and the VSWR characteristic illustrated in FIG. 12 that, when the magnetic substance as the interposition 3 has the conductivity σ=0.1 [/Ωm], the use of the matching capacitor greatly improves the matching, and secures about 2 GHz (relative bandwidth: about 50%) around 4 GHz as the operational bandwidth, assuming that the bandwidth within which the VSWR is less than 3 is the operational bandwidth. It is also confirmed that about 1.5 GHz is attained around 4 GHz as the operational bandwidth, assuming that the bandwidth within which the VSWR is less than 2 is the operational bandwidth.

It is confirmed from the Smith chart and the VSWR characteristic illustrated in FIG. 13 that, when the magnetic substance as the interposition 3 has the conductivity σ=1.0 [/Ωm], the use of the matching capacitor greatly improves the matching, and secures about 3 GHz (relative bandwidth: about 70%) around 4.5 GHz as the operational bandwidth, assuming that the bandwidth within which the VSWR is less than 3 is the operational bandwidth. It is also confirmed that about 1.5 GHz is attained around 4 GHz as the operational bandwidth, assuming that the bandwidth within which the VSWR is less than 2 is the operational bandwidth.

It is also confirmed from the Smith chart and the VSWR characteristic illustrated in FIG. 14 that, when the magnetic substance as the interposition 3 has the conductivity σ=10.0 [/Ωm], the use of the matching capacitor greatly improves the matching, and secures about 4 GHz (relative bandwidth: about 80%) around 5 GHz as the operational bandwidth, assuming that the bandwidth within which the VSWR is less than 3 is the operational bandwidth. It is also confirmed that about 2 GHz is attained around 5 GHz as the operational bandwidth, assuming that the bandwidth within which the VSWR is less than 2 is the operational bandwidth.

And, in consideration of the simulation results of FIG. 12 through FIG. 14, it is confirmed that the interposition of the magnetic substance having the conductivity of about 0.1

[/Ωm] through 10.0 [/Ωm] between the reference conductor 1 and the radiation conductor 2 achieves a wideband characteristic covering a relative bandwidth more than 50% around 4 or 5 GHz, assuming that the bandwidth within which the VSWR is less than 3 is the usable frequency range (operational bandwidth).

From the comparison of the general patch antenna using the insulating material (dielectric substance) having the conductivity σ=0.003 [/Ωm] as the interposition 3, as shown in FIG. 19, and the wideband antenna of the third embodiment that uses the magnetic substance having the conductivity σ=0.1 [/Ωm] and the relative permeability μr=4.0 as the interposition 3, as shown in FIG. 12, it is clearly found that the wideband antenna of the third embodiment achieves a sufficient widening of the operational bandwidth. Further, as shown in FIG. 12 through FIG. 14, loading a matching capacitor from the outside will greatly improve the matching, which makes it possible to achieve a very thin-type wideband antenna that answers a wide range of use.

In the third embodiment, the conductivity of the magnetic substance is specified within about 0.1 through 10.0. However, in the same manner as the wideband antenna of the second embodiment, to use the magnetic substance having the relative permeability μr of more than 1.0 through about 8.0 in addition to the above will further improve the characteristic. That is, to use the magnetic substance having the conductivity σ of about 0.1 through 10.0 and the relative permeability μr of more than 1.0 through about 8.0 as the interposition 3 will achieve a thin-type wideband antenna having a better characteristic.

[On the Method of Forming Substances Having Objective Conductivities]

The first embodiment and the third embodiment used a dielectric or magnetic substance whose conductivity is about 0.1 through 10.0 in the usable frequency band as the interposition 3 interposed between the reference conductor 1 and the radiation conductor 2.

There are several methods of forming the substance whose conductivity is about 0.1 through 10.0 in the usable frequency band. One conceivable method is to vary the composition of the dielectric or magnetic substance as the interposition, such as mixing a conductive material such as carbon by an appropriate quantity when the substance used as the interposition 3 is a dielectric, or varying the composite rate of ferrite when the substance used as the interposition 3 is a magnetic.

Besides, there is another conceivable method of forming the substance whose conductivity is about 0.1 through 10.0 in the usable frequency band, on the basis of the construction of the wideband antenna of this invention that interposes the interposition 3 between the reference conductor 1 and the radiation conductor 2.

As shown in FIG. 1 and FIG. 10, when the radiation conductor 2 is provided on the surface of the interposition 3, the radiation conductor 2 is formed on the surface of the interposition 3 by the technique of application, evaporation, adhesion, plating, or the like. Now, if the surface of the interposition 3 on which the radiation conductor 2 is provided is rough, the dielectric tangent tan δ is large, and the loss becomes high. To use this property will attain the conductivity σ of the objective value, or will approximate it to the objective.

That is, in the first and second embodiments, the wideband antenna was intended to make the bandwidth wider by using the material in the area of the larger tan δ, namely, in the area of the larger conductivity, in comparison to the case of using the general dielectric material. Therefore, in case of forming the radiation conductor 2 on the surface of the interposition 3 of the dielectric or magnetic substance, the conductivity close to the desired one was attained by making rougher the material surface of the interposition 3 on which the radiation conductor 2 is formed than the average surface roughness generally used.

With regard to the deterioration of the tan δ due to the roughness of the material surface, the depth of the outermost layer being the function of the conductivity of the radiation conductor itself and the frequency used is considered as a measure. Accordingly, as a measure of the average surface roughness for obtaining a large tan δ (large conductivity) such as the abovementioned case (conductivity σ=0.1 through 10.0), more than about ten times the depth of the outermost layer can be the measure.

Here, the depth D [m] of the outermost layer is given by the expression (1).

$$D[m]=Sqrt[2/(\mu\ \sigma m\ \omega)] \quad (1)$$

Here, μ is the permeability of the metal used, generally $\mu=\mu^0=1.26\times10^{-6}$ [H/m], σm is the conductivity [/Ωm] of the metal used, and ω is the angular frequency [rad/m].

Thus, on the basis of the depth D [m] of the outermost layer that is calculated by the conductivity of the radiation conductor 2 and the frequency used, the roughness of the surface of the interposition 3 on which the radiation conductor 2 is formed is determined, and the interposition 3 having the surface of the roughness is formed. Thereby, the material usable for the interposition 3 having a closer conductivity to the desired one can be obtained.

In this manner, in order to form the material usable for the interposition 3 having the desired conductivity σ, there are methods of adjusting the rate of the compositions, and roughening the surface roughness of the interposition 3 on which the radiation conductor 2 is provided and so forth, which are feasible. Naturally, it is not limited to form the material whose conductivity σ is about 0.1 through 10.0 by the other method than the abovementioned, and it may be used as the interposition.

Fourth Embodiment

The wideband antennas of the first, second, and third embodiments were made with attention to the interpositions interposed between the reference conductor 1 and the radiation conductor 2. And, when a wideband antenna is formed to follow the first, second, or third embodiment, there can be a situation that demands to further widen the operational bandwidth.

Now, the fourth embodiment is to further widen the operational bandwidth by forming a feeder line existing between the reference conductor 1 and the radiation conductor 2 in a tapered shape.

Figure 15:
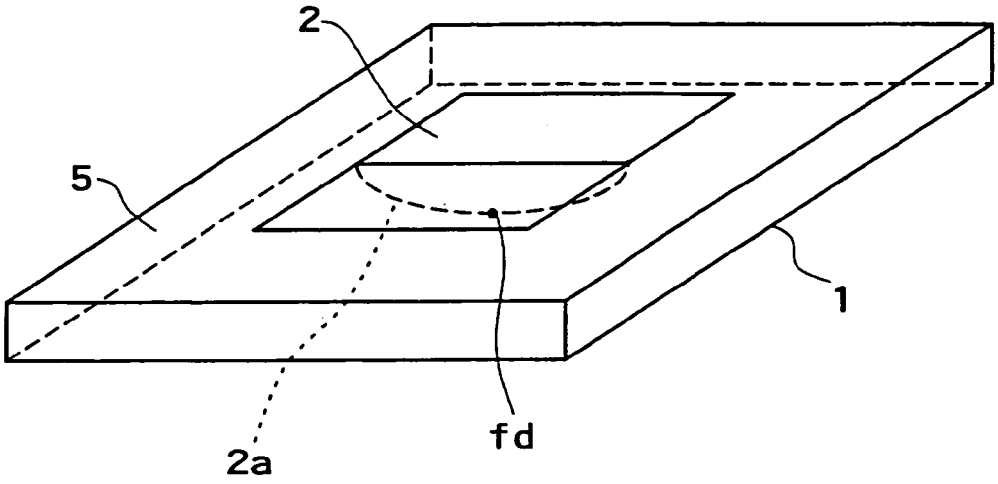
FIG. 15 illustrates a construction as one example of the fourth embodiment of the wideband antenna according to the invention.

FIG. 15 illustrates a construction as one example of the fourth embodiment, in which the invention is applied to the so-called thin-type wideband antenna in the same manner as in the first, second, and third embodiments.

As shown in FIG. 15, the feeder line existing between the reference conductor 1 and the radiation conductor 2 is formed in a tapered shape. In the example of FIG. 15, the feeder line **2*a* is formed in the so-called tapered shape by narrowing the width gradually from the radiation conductor 2 toward the reference conductor 1**.

Here, although the signal feeding point fd exists on nearly the same plane, it is insulated from the reference conductor 1. The ground feeding point (not illustrated) on the reference conductor 1 is provided close to the signal feeding point fd. To form the feeder line 2*a* in the tapered shape in this manner will further widen the bandwidth.

As shown in FIG. 15, to apply the construction with the feeding line 2*a* formed in the tapered shape to the wideband antennas of the first, second, or third embodiments will further widen the operational bandwidth.

In the example of FIG. 15, the construction is applied to the so-called thin-type antenna that is formed so as to face the whole surface of the radiation conductor 2 to the reference conductor 1, however it is not limited to this.

Figure 16:
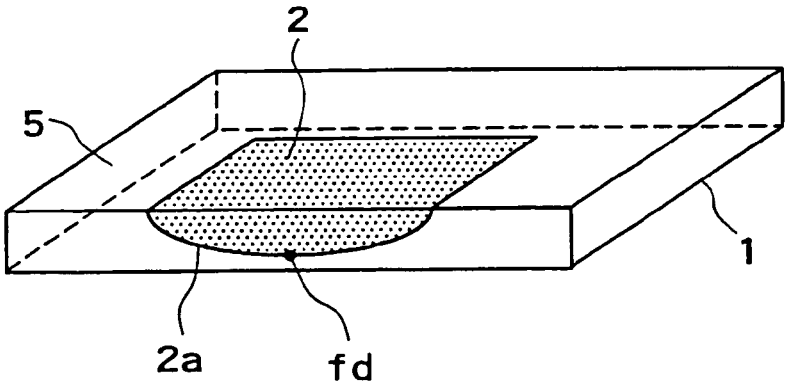
FIG. 16 illustrates a construction as another example of the fourth embodiment of the wideband antenna according to the invention.

For example, the construction may be made such that the radiation conductor 2 is applied on the side and upper surface of the interposition 5 whose conductivity σ is about 0.1 through 10.0, as shown in FIG. 16, whereby the feeder line 2*a* applied on the side is formed in the tapered shape.

Figure 17:
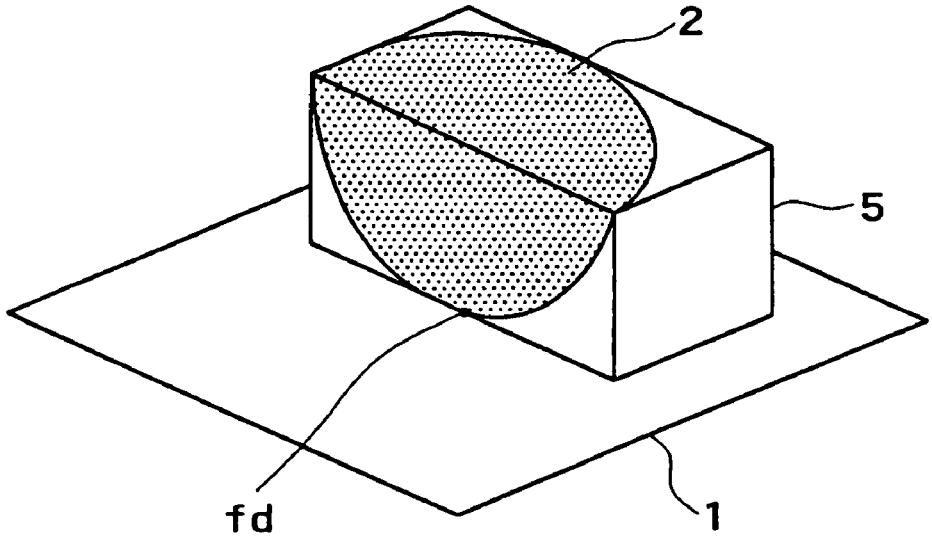
FIG. 17 illustrates a construction as another example of the fourth embodiment of the wideband antenna according to the invention.

As shown in FIG. 17, the wideband antenna may be formed such that a parallelepipedonal interposition 5 is provided on the reference conductor 1, and a circular-plane radiation conductor 2 is applied on the side perpendicular to and the side parallel to the reference conductor 1 of the interposition 5.

In this case, the dielectric or magnetic substance whose conductivity σ is about 0.1 through 10.0, the magnetic substance whose relative permeability is more than 1.0 through about 8.0, or the magnetic substance whose conductivity σ is about 0.1 through 10.0, whose relative permeability is more than 1.0 through about 8.0 can be used as the interposition 5.

Figure 18:
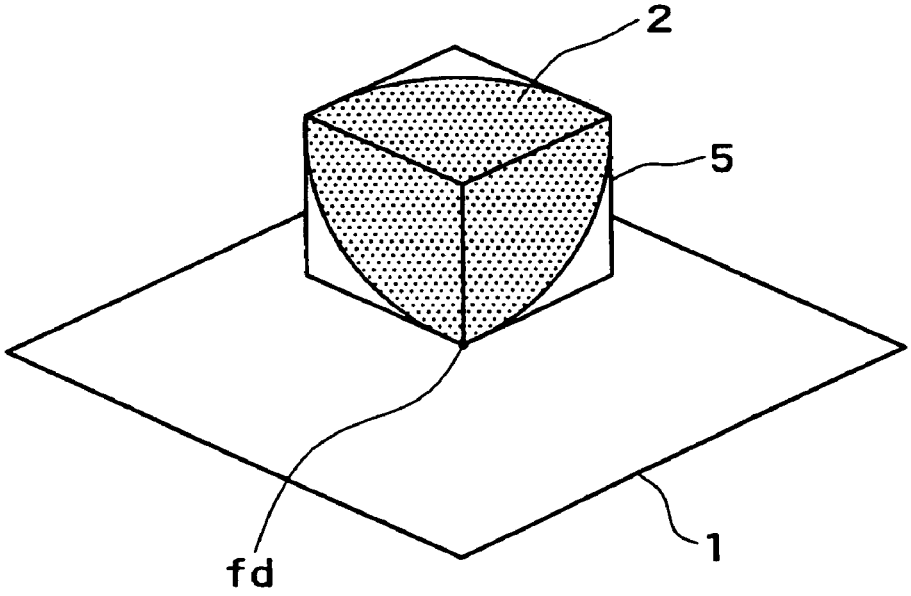
FIG. 18 illustrates a construction as another example of the fourth embodiment of the wideband antenna according to the invention.

As shown in FIG. 18, the wideband antenna may be formed such that a cubic interposition 5 is provided on the reference conductor 1, and a circular-plane radiation conductor 2 is applied on the two sides perpendicular to the reference conductor 1 and the one side parallel to the reference conductor 1 of the adjoining three sides of the interposition 5. Also in this case, the dielectric or magnetic substance whose conductivity σ is about 0.1 through 10.0, the magnetic substance whose relative permeability is more than 1.0 through about 8.0, or the magnetic substance whose conductivity σ is about 0.1 through 10.0, whose relative permeability is more than 1.0 through about 8.0 can be used as the interposition 5.

Here, in each of FIG. 15 FIG. 16, FIG. 17, and FIG. 18, the symbol fd denotes the signal feeding point. The signal feeding point fd exists on substantially the same plane as the reference conductor 1, however it is insulated from the reference conductor 1. The ground feeding point (not illustrated) of the reference conductor 1 is provided adjacently to the signal feeding point fd. And, in each of FIG. 15 FIG. 16, FIG. 17, and FIG. 18, in order to form the radiation conductor 2 on the surface of the interposition 5, various methods such as application, evaporation, adhesion, and plating and so forth can be used.

In this manner, to form the feeder line in a tapered shape allows a further widening of the operational bandwidth.

In the first, second, and third embodiments, the shape of the radiation conductor 2 was rectangular, however it may be the other shape such as circular. In the manufacturing, a dielectric or magnetic substance with copper layers spread on both the sides thereof can be made through the etching and very simple processing, which makes the wideband antenna inexpensive.

The shape of the interposition 3 is not limited to the examples described in the above embodiments, and different shapes and sizes can be used. For example, it is possible to use such an interposition that the surface area thereof supporting the radiation conductor 2 is smaller than the plane of the radiation conductor 2. It is not necessarily required that the interposition and the reference conductor, or the interposition and the radiation conductor are adhered, and they may be made up with a gap.

And, the interposition 3 uses a dielectric in the first embodiment, the interposition 3 uses a magnetic substance in the third embodiment, and the interposition 5 uses a dielectric or magnetic substance in the fourth embodiment. However, the interposition is not limited to a dielectric or a magnetic substance; for example, foaming solids (substance whose relative dielectric constant and relative permeability is about 1) may be used.

The foregoing invention has been described in terms of preferred embodiments. However, those skilled, in the art will recognize that many variations of such embodiments exist. Such variations are intended to be within the scope of the present invention and the appended claims.

What is claimed is:

1. A wideband antenna, comprising:

a reference conductor;

a radiation conductor, at least parts of the reference conductor and the radiation conductor being disposed so as to face each other;

a magnetic substance whose relative permeability is more than 1 through about 8 in an operational radio frequency and whose relative dielectric constant is ≦10 is interposed between the reference conductor and the radiation conductor of the wideband antenna, wherein; and a feed connected to at least the radiation conductor to transmit power thereto, wherein the feed has a tapered shape which widens as the feed approaches the connection to the radiation conductor.

2. The antenna of claim 1, wherein the radiation conductor is in the form of a substantially flat plate, and is disposed in close proximity to and substantially in parallel to the reference conductor.

3. The antenna of claim 1, wherein the conductivity of the magnetic substance in the operational radio frequency is about 0.1 [/Ωm] through 10 [/Ωm].

4. The antenna of claim 1, wherein, at least one capacitor is connected in series or parallel to the feed.

5. The antenna of claim 1, further comprising:

a short-circuiting pin which is electrically connected to the radiation conductor and the reference conductor.

6. The antenna of claim 1, further comprising:

a ground feeding point in contact with the reference conductor.

* * * * *